United States Patent [19]

Lokkesmoe et al.

[11] Patent Number: 4,911,856

[45] Date of Patent: Mar. 27, 1990

[54] LOW ACID, SOLUBLE SALT CONTAINING AQUEOUS-ORGANIC SOFTENING AGENTS FOR DETERSIVE SYSTEMS

[75] Inventors: Keith D. Lokkesmoe, Burnsville; Michael E. Besse, Golden Valley; Keith E. Olson, Apple Valley, all of Minn.

[73] Assignee: Ecolab Inc., St. Paul, Minn.

[21] Appl. No.: 277,897

[22] Filed: Nov. 30, 1988

[51] Int. Cl.[4] ..... C11D 3/395; C11D 7/24; C11D 17/00

[52] U.S. Cl. ..... 252/95; 252/89.1; 252/99; 252/135; 252/174.13; 252/174.14; 252/174.16; 252/174.23; 252/175; 252/181; 252/309; 252/544; 252/DIG. 14

[58] Field of Search ..... 252/89.1, 95, 99, 135, 252/174.13, 174.14, 174.16, 174.23, 175, 181, 309, 544, DIG. 14

[56] References Cited

U.S. PATENT DOCUMENTS

| | | | |
|---|---|---|---|
| Re. 28,002 | 4/1971 | Li et al. | 210/22 |
| Re. 30,179 | 12/1979 | Li et al. | 210/22 |
| 3,389,078 | 6/1968 | Elzinga et al. | 208/308 |
| 3,410,794 | 11/1968 | Li | 208/308 |
| 3,617,546 | 11/1971 | Li et al. | 210/22 |
| 3,637,488 | 1/1972 | Li et al. | 210/22 |
| 3,740,315 | 6/1973 | Li et al. | 195/2 |
| 3,779,907 | 12/1973 | Li et al. | 210/22 |
| 3,923,678 | 12/1975 | Kleiner et al. | 252/89 |
| 3,969,265 | 7/1976 | Singhal et al. | 252/309 |
| 4,081,369 | 3/1978 | Li et al. | 210/22 |
| 4,086,163 | 4/1978 | Cahn et al. | 210/22 |
| 4,151,076 | 4/1979 | Reinhardt et al. | 210/21 |
| 4,183,960 | 1/1980 | Asher et al. | 424/365 |
| 4,235,713 | 11/1980 | Nogueira et al. | 210/638 |
| 4,259,189 | 3/1981 | Li | 260/29.6 |
| 4,287,071 | 9/1981 | DiGiacomo | 210/643 |
| 4,292,181 | 9/1981 | Li et al. | 210/638 |
| 4,334,999 | 6/1982 | Cornwell | 210/638 |
| 4,337,225 | 6/1982 | Dines | 423/10 |
| 4,362,642 | 12/1982 | Carter et al. | 252/174.16 |
| 4,369,317 | 1/1983 | Hawkins | 544/110 |
| 4,379,041 | 4/1983 | Petranek et al. | 204/415 |
| 4,437,994 | 3/1984 | Baker | 210/638 |
| 4,461,709 | 7/1984 | Batzer et al. | 210/643 |
| 4,500,494 | 2/1985 | Scher | 423/24 |
| 4,540,448 | 9/1985 | Gautier et al. | 148/6.15 |
| 4,555,343 | 11/1985 | Bauer et al. | 210/643 |
| 4,587,106 | 5/1986 | Bauer et al. | 423/8 |
| 4,793,942 | 12/1988 | Lorkesmoe et al. | 252/99 |

FOREIGN PATENT DOCUMENTS 1113712 1/1966 United Kingdom .

OTHER PUBLICATIONS

C. F. Vandergrift and E. P. Horwitz, *Journal of Inorganic Nuclear Chemistry*, 1977, vol. 30, pp. 1425–1432.

I. Komasawa, T. Otake and Y. Higaki, *Journal of Inorganic Nuclear Chemistry*, 1981, vol. 43, pp. 3351–3356.

M. S. White and Lakshminarayanaiah, *Currents in Modern Biology* 1969, pp. 39–44.

*The Journal of the American Oil Chemists Society*, vol. 40, pp. 642–645, Sep. 1963.

*Primary Examiner*—Prince E. Willis

*Attorney, Agent, or Firm*—Merchant, Gould, Smith, Edell, Welter & Schmidt

[57] ABSTRACT

An agent for removing hardness from an aqueous phase comprising: about 25 to 95 vol.-% of an exterior organic phase having an organic medium; and about 0.1 to 99.9 wt-% based on the organic phase of an organic soluble hardness ion complexing agent; and about 5 to 75 vol.-% of an inner aqueous phase dispersed within the exterior organic phase which comprises water; and about 1 to 90 wt-% based on the inner aqueous phase of an aqueous soluble salt; and about 0.1 to 50 wt-% based on the organic phase of a surfactant that can stabilize the dispersed inner aqueous phase within the exterior organic phase. Detersive systems which can remove divalent or trivalent ions from service water and can clean soiled surfaces or articles which contain the softening agent. Methods of making and using the softening agent. Methods of making and using the detersive system.

52 Claims, 2 Drawing Sheets

LOW ACID, SOLUBLE SALT CONTAINING AQUEOUS-ORGANIC SOFTENING AGENTS FOR DETERSIVE SYSTEMS

FIELD OF THE INVENTION

The invention relates to the use of a detersive system containing a soil removing detergent and a dispersed low acid aqueous-organic softening agent containing a soluble salt that can remove hardness from service water during detergent action. The liquid softening agent of the invention can be used to remove hardness cations from an aqueous medium or use solution containing a detersive system either before or during detergent action. More particularly the properties of the softening agent of the invention are improved in that the absence of acid in the liquid softening agent reduces the potential for corrosion of metals and alloys with which the liquid softening agent comes into contact. In addition, the absence of acid in the liquid softening agents allows for the selection from a wider variety of the components of the softening agent since they do not need to be acid stable, thus providing for the possibility of a more cost effective softening agent.

BACKGROUND OF THE INVENTION

Detersive systems have been used for many years in many cleaning environments including the laundry, warewashing, hard surface cleaning, and other applications. Typically, detersive systems are concentrates comprising mixtures of cleaning ingredients that when mixed with water form a cleaning medium or use composition. Service water, containing some concentration of hardness ions, supplied by local water utilities is most commonly used in making the use composition. Hardness ions are typically undesirable in conjunction with detersive systems since they interfere in the soil removal mechanism. The quality of service water varies from place to place throughout the country and can vary in the amount of hardness and can vary in the type of hardness components. Hardness typically comprises metal ions including calcium, magnesium, iron, manganese, and other typically divalent or trivalent metal cations, depending on the source of the water. The presence of hardness cations in service water can substantially reduce the detersive action or effectiveness of a detersive system, can result in the incomplete cleaning of laundry, dishware, hard surfaces, and other soiled items or surfaces and can leave films or scale comprising the hardness cation and/or components of the detersive system.

A great deal of attention in recent years has been given to the components of detersive systems that reduce the effects of the hardness components. Common hardness sequestering agents comprise inorganic chemicals such as a condensed phosphate compound and a zeolite, and organic sequestrants such as EDTA, organic phosphonates and organic phosphinates. Such agents are effective in treating hardness in service water by a chemical reaction which keeps the ions in the aqueous bulk detersive system but reduces the hardness effect of the ions on the detersive systems. These agents can be effective but can result in both economic and ecological disadvantages.

Recently, softening agents have been prepared for hardness treating or water softening. Such liquid agents can be used in detersive systems at low concentration and can effectively soften service water through a mechanism of removing hardness ions from aqueous media used in detersive systems with little adverse environmental impact or compatibility problems in detersive systems. Such systems work through an organic phase, containing a complexing agent, dispersed in the bulk aqueous phase or aqueous detersive system. The organic phase contains an internal dispersed acid aqueous phase. Hardness ions in the bulk aqueous phase are transferred to the internal acidic aqueous phase through the organic phase by the complexing agent. The driving force of the softening effect is caused by the chemical potential difference in hydrogen ion activity between the inner acidic aqueous phase and the bulk aqueous solution.

We have discovered a novel liquid membrane softening agent that does not contain acid in its internal aqueous phase and thus decreases the potential for corrosion to metals or alloys with which the non-acidic liquid membrane softening agent comes into contact. This reduction in corrosivity will allow for much less costly equipment in both the manufacturing of the softening agent and the detersive system. The use of the softening agent of the invention also result in the benefit of less potential for corrosion at the washing process site. Another possible benefit of this new liquid softening agent is the increased stability of any active chlorine sources which may be included in the detersive systems in which the softening agents maybe included. The liquid membrane softening agent is also advantageous in that a wider variety of organic solvents, surfactants, and complexing agents rather than just acid stable organic solvents, surfactants, and complexing agents can be used in the softening agent resulting in the possibility of a more cost effective softening agent.

BRIEF DESCRIPTION OF THE INVENTION

We have found that a dispersion of a non-acidic or low acid aqueous-organic hardness removing, or water softening, agent can be used in conjunction with detergent components in detersive systems. In an aqueous detersive system, the softening agent is a dispersion, in the bulk aqueous phase, of small liquid or solid organic droplets having an internal aqueous phase.

In somewhat greater detail, the softening agent comprises a dispersion of small droplets having an exterior organic phase, an inner aqueous phase containing an ionized salt, and a surfactant stabilizing the water in oil emulsion. The exterior organic phase comprises an organic medium which can be liquid or solid at room temperature and an organic soluble complexing agent that can chemically bind hardness components.

The inner aqueous phase comprises a solution of strongly ionized salt that acts as a sink or depository for hardness ions.

Figure 1:
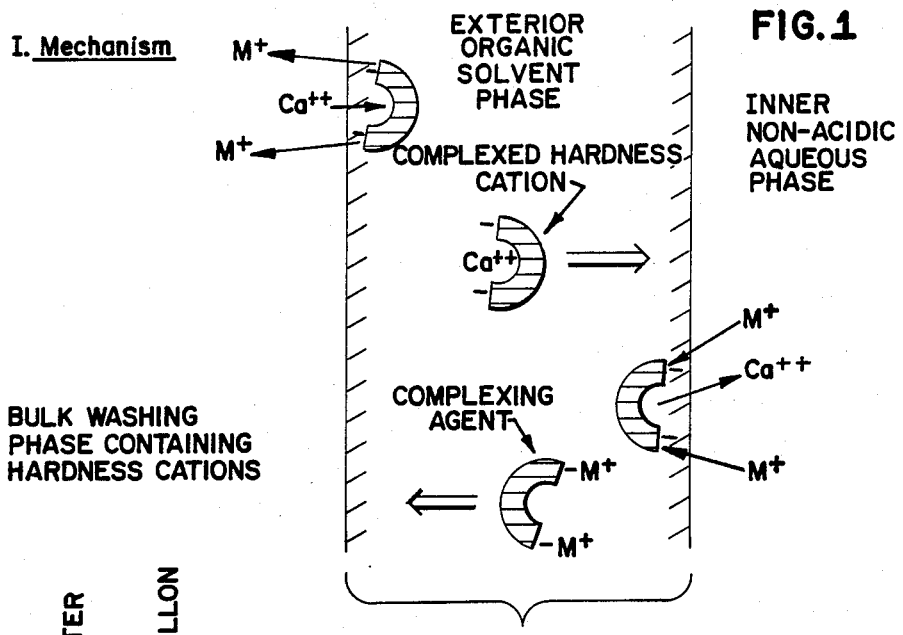
FIG. 1 is a description of the mechanism of hardness removal from a bulk aqueous phase.
Figure 2:
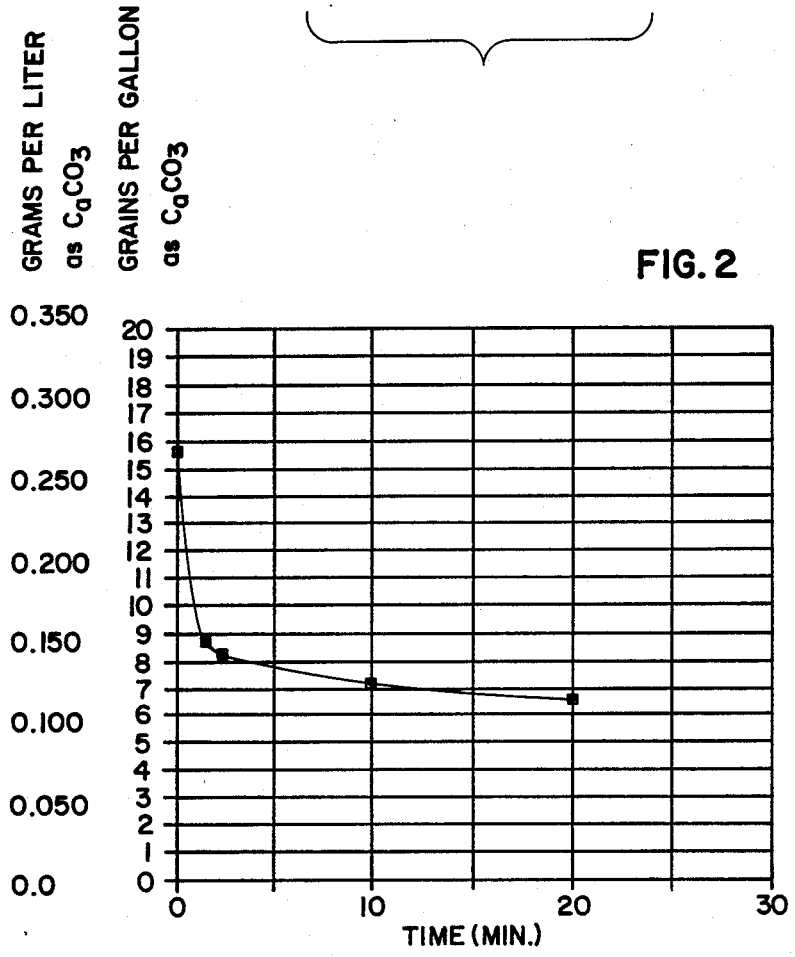
FIG. 2 is a graphical representation showing the softening properties of the softener of Example II.
Figure 3:
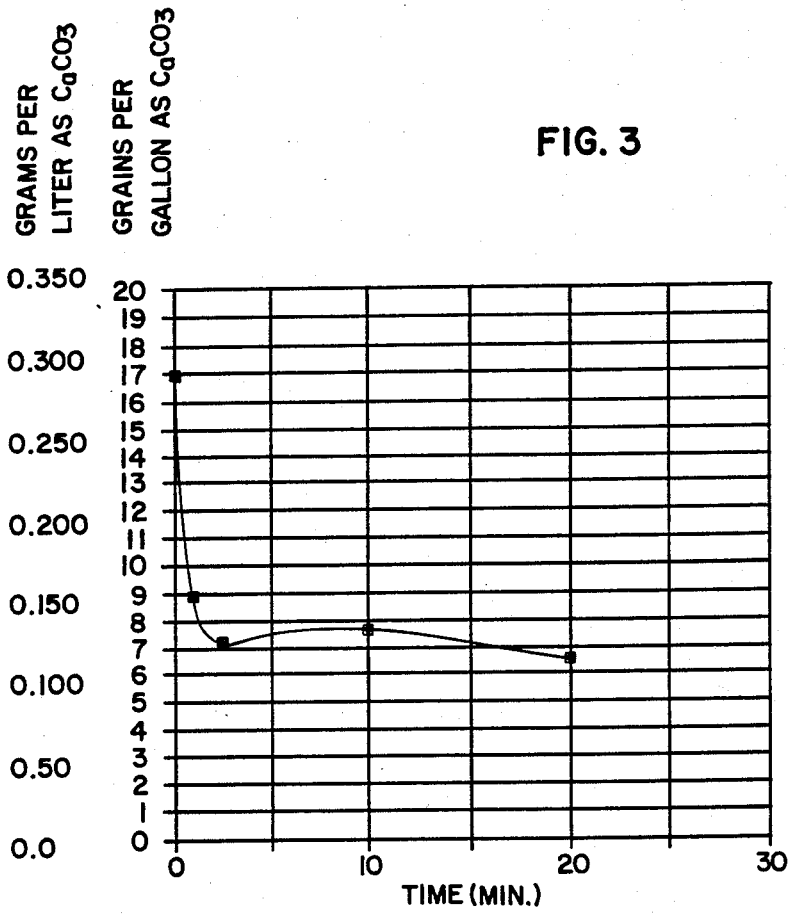
FIG. 3 is a graphical representation showing the softening properties of the softener of Example III.

Our current understanding of one possible mechanism for the action of the softening agent is as follows. At the interface between the organic phase and the bulk aqueous phase, the complexing agent first reacts with and extracts the hardness cations into the exterior organic phase, simultaneously releasing neutral salt cations displaced from the complexing agent into the bulk aqueous phase. The hardness cation-complexing agent reaction product is then transferred to the interface between the inner aqueous phase and the exterior organic phase. There the hardness cation on the complexing agent is exchanged into the inner aqueous phase for neutral salt cations. The hardness cations remain in the non-acidic inner aqueous phase. The neutral salt cations regenerate the complexing agent for a repeat of the cycle (see FIG. 1). In this way, calcium, magnesium, iron, manganese, and other divalent or trivalent hardness cations can be transferred against a concentration gradient if the complexing agent has an affinity for the hardness cation and a sufficient neutral salt concentration gradient exists between the inner aqueous phase of the softening agent through the organic phase to the bulk aqueous detersive system phase. Neutral salt cations are thus transferred countercurrently to the hardness cations and their concentration gradient provides a driving force to cause transfer of the hardness cations.

The inner aqueous phase is first emulsified in the exterior organic phase containing an organic soluble complexing agent with a surfactant to stabilize the emulsion. The softening agent is then dispersed in the bulk aqueous phase or the detergent composition. When the detergent composition is contacted with water to form a detersive system, the softening agent is then released into the use composition during the release of the detersive system. Alternatively the softening agent can be added to the aqueous wash medium or aqueous phase separately from the detergent composition. The softening agent thus functions in the use composition as a water-in-oil-in-water emulsion. The emulsion is designed to be stable or to stay intact to soften the aqueous medium at least for the duration of a wash cycle process or step. The complexing agents of this invention improve both softening performance and the stability of the softening agent. We have found that the use of a soluble salt in the inner aqueous phase provides a number of advantages including the reduction of the possibility of corrosion of metals and alloys with which the softening agent comes into contact. The liquid membrane softening agent of the present invention is also advantageous in that a wider variety of organic solvents and surfactants can be used in the softening agent resulting in the benefit of a more cost effective softening agent.

One aspect of this invention relates to a softening agent itself. A second aspect of this invention relates to a detersive system containing the softening agent. A third aspect of this invention relates to a method of using a detersive system containing the softening agent in an aqueous use medium for cleaning or soil removal purposes. A fourth aspect of this invention relates to a method of preparing the softening agent of this invention. A fifth aspect of this invention relates to a method of preparing the detersive system containing the softening agent.

DETAILED DISCUSSION OF THE INVENTION

The detersive systems of our invention comprise a soil removing detergent and a dispersed softening agent having an inner aqueous phase stabilized by a surfactant within an exterior organic complexing (or carrier) agent phase.

SOFTENING AGENT

The softening agent of the invention comprises two phases, an exterior organic phase and an inner aqueous phase, containing a strongly ionized salt, dispersed and contained within the exterior organic phase. The organic and aqueous phases of the softening agent are stabilized with a surfactant to form a water in oil emulsion.

Typically, the surfactant is present in the softening agent and appears at the interface between the organic phase and the inner aqueous phase. After the softening agent is prepared, the surfactant can be also present in both the aqueous and the organic phases. The stabilizing surfactant can be added to the organic phase during the preparation of the softening agent, and is typically mixed with the organic phase prior to the preparation of the softening agent. The inner aqueous phase of the softening agent serves as a sink or depository to contain the hardness cations which have been extracted from the bulk aqueous washing phase by the complexing agent. If substantial amounts of the inner aqueous phase of the softening agent are released into the bulk aqueous phase during cleaning, the extent of softening can be substantially reduced.

The surfactant can be used at a concentration of about 0.01 to about 50 wt-% based on the total weight of the organic phase. Preferably, the amount of surfactant used ranges from about 1 to 30 wt-% of the organic phase and most preferably, for reasons of economy and emulsion stability, about 1 to 20 wt-% of the stabilizing surfactant is used based on the total weight of the organic phase.

The surfactant used is preferably oil soluble with a polymeric hydrophobic portion. Polysuccinimide derivatives and methods to make them are disclosed in U.S. Pat. Nos. 3,018,291 (Anderson et al); 3,172,892 (LeSuer et al); 3,219,666 (Norman et al); 3,024,237 (Drummond et al); 4,259,189 (Li) and 4,292,181 (Li et al) which are hereby incorporated by reference.

The exterior organic phase can comprise from about 25 to 95 vol-% of the softening agent. The inner aqueous phase can comprise from about 5 to 75 vol-% of the softening agent. Preferably the exterior organic solvent phase comprises from about 25 to 80 vol-% of the softening agent and the inner aqueous phase comprises from about 20 to 75 vol-% of the softening agent for reasons of economy. Most preferably the exterior organic solvent phase comprises from about 30 to 80 vol-% of the softening agent and the inner aqueous phase comprises from about 20 to 70 vol-% of the softening agent for reasons of economy. We have found that smaller droplet sizes yield greater rates of softening due to an increased surface area increasing the rate of extraction of hardness. We have also found that the use of smaller amounts of the softening agent is preferred since the softening agent contains an organic solid or liquid solvent such as an oil. The softening agent can have a droplet size of from about 0.05 to 2000 microns, preferably from about 1.0 to 1000 microns, and most preferably to reduce the amount of organic medium and increase rate of softening the droplet size is about 1 to 500 microns.

Exterior Organic Phase

The exterior organic phase of the softening agent comprises a liquid, semi-solid or solid organic medium, at room temperature, and a effective amount of an organic soluble complexing or chelating agent. In the detersive systems of the invention, the softening agent can either be liquid or solid at room temperature. At use temperature the softening agent is preferably liquid or semi-liquid. Alternatively the softening agent can be a semi-solid or solid matrix that can protect the softening agent from shear forces, with a separate liquid phase contained within the solid matrix which allows the diffusion of the cation-complexing agent reaction product through the pores of the solid matrix.

Complexing Agent

Virtually any complexing agent soluble in the organic phase of the softening agent of the invention and reactive with the di- and trivalent metal ions comprising aqueous hardness components can be used in the softening agents of the invention. Complexing or chelating agents are organic or inorganic molecules or ions (ligand) that can coordinate a metal ion in more than one position. Ion pair salts of the hardness cations and the organic soluble complexing agent that do not necessarily chelate the metal cations are also included in this definition. Coordination is a particular chemical reaction in which a ligand through two or more electron donor groups can bind to a metal ion. Primarily chelating or complexing agents comprise organic ligand groups having efficient functional electron donor groups that can react with and stabilize metal ions. Many organic and inorganic chelating agents are shown, for example, in Baker, U.S. Pat. No. 4,437,994 at column 7, lines 7–69, columns 811, and column 12, lines 1–4, and in Kirk-Othmer *Encyclopedia of Chemical Technology*, 2nd Ed., Vol. 6, pp. 1–24.

Examples of complexing agents useful in the exterior organic solvent phase of the liquid softening agent include but are not limited to the following: alkyl substituted phosphorous acid such as a phosphoric, phosphonic, and phosphinic acid, alkyl substituted sulfuric and sulfonic acids, mono-, di- and tricarboxylic agents and alkyl substituted mono-, di- and tricarboxylic acids, salts thereof and mixtures thereof. It should be noted that these organic acid complexing agents are converted to their neutral salts either before preparation or during use of the softening agent in the detersive system. We have found that complexing agents containing at least 25 carbon atoms are particularly useful due to their generally more stable dispersion within the exterior organic phase and lack of solubility in alkaline wash water.

We believe that the complexing agent preferably comprises a molecule of the formula:

$$(RO)_2-\overset{\overset{\displaystyle O}{\|}}{P}-OH$$

wherein each R is independently a $C_{8-36}$ alkyl group, preferably a $C_{16-30}$ alkyl group, most preferably a $C_{20-30}$ alkyl group, or mixtures thereof.

The preferred complexing agent for hardness ion removal including the preferred bis(hexadecyl) phosphoric acid, bis(eicosenyl) phosphoric acid and bis(hexacosyl) phosphoric acid are typically made by a reaction between the aliphatic alcohol and phosphorous trichloride resulting in a dialkyl phosphite. The dialkyl phosphite is then reacted with a stoichiometric amount of gaseous chlorine. The reaction results in a dialkyl phosphochloridate. The dialkyl phosphorochloridate can be hydrolyzed yielding the dialkyl phosphate. These reactions are set forth below:

$$3ROH + PCl_3 = (RO)_2-\overset{\overset{\displaystyle O}{\|}}{P}-H + RCl + 2HCl$$

$$(RO)_2-\overset{\overset{\displaystyle O}{\|}}{P}-H + Cl_2 = (RO)_2-\overset{\overset{\displaystyle O}{\|}}{P}-Cl + HCl$$

$$(RO)_2-\overset{\overset{\displaystyle O}{\|}}{P}-Cl + H_2O = (RO)_2-\overset{\overset{\displaystyle O}{\|}}{P}-OH + HCl$$

For additional detail with respect to the manufacture of the dialkyl phosphate complexing agents of this invention, please see Cooper, *The Journal of the American Oil Chemists Society*, Vol 40, pp. 642–645, September, 1963. The aliphatic alcohols are available from a number of sources including Exxon Corporation.

The exterior organic solvent phase can comprise about 0.1 to 99.9 wt-% of an organic medium and about 0.1 to 99.9 wt-% of a complexing agent. Preferably the organic solvent phase comprises about 20 to 90 wt-% of an organic medium, and about 1 to 50 wt-% of a complexing agent or mixtures thereof for reasons of emulsion stability and economy.

Most preferably the organic solvent phase comprises about 25 to 90 wt-% of an organic medium and about 1 to 40 wt-% of a complexing agent or mixtures thereof for reasons of emulsion stability and economy.

Organic Mediums

Organic compositions useful in the exterior organic phase of the softening agent include essentially organic liquids, solids and semi-solids in which the hardness ion complexing agent are soluble. Useful liquid organics include compositions having a flash point preferably in excess of 200° F. Such liquids typically come in the form of a light, chemically inert oil of low volatility. Preferred organic mediums comprise saturated paraffinic or naphthenic or aromatic organic liquids and solids and mixtures thereof. Most importantly the organic medium should be relatively non-toxic, non-reactive with the inner aqueous phase, and have low solubility in the bulk aqueous phase. Broadly, compounds that can be used as the organic medium include paraffinic hydrocarbons, naphthenic hydrocarbons, aromatic hydrocarbons, fatty acids and fatty alcohols that can be both liquid and solid at room temperature, including waxes, hydroxy waxes, fluorocarbon solvents, acid stable silicone oils and others. Most preferred organic solvents include light petroleum oils, paraffinic waxes, highly refined white oils and mixtures thereof.

In certain instances, a wax composition can be used as a solid component of the exterior organic phase or as an encapsulate in conjunction with a second, exterior organic phase component. Wax which is typically a saturated hydrocarbon compound solid at room temperature but melting prior to typical cleaning temperatures of bulk aqueous phase, can be used as the organic phase or in conjunction with a liquid organic phase where additional stability of the softening agent is required. In granular systems, the softening agent can be prepared in a wax form stabilizing the emulsion within the wax particle. In liquid or solid detersive systems, the wax at room temperature can remain in solid form and can protect the organic components of the softening agent from any adverse interaction with the cleaning components of the detersive systems.

Historically waxes are known to include substances that are natural and synthetic products. Chemically naturally occurring waxes are esters of fatty acids and monohydric fatty alcohols, relatively high molecular weight monohydric fatty alcohols, and other components. Modern synthetic waxes typically include saturated hydrocarbons having aliphatic or open chain structures with relatively low branching or side chains. Physically waxes are water repellant solids at room temperature having a useful degree of plastic character. Particularly preferable waxes for use in the softening agent compositions of the invention are petroleum waxes, beeswax, microcrystalline wax, slack wax, and paraffin wax. Particularly useful waxes are solids at room temperature but have softening points or melting points at the temperature of use of the detersive system, commonly above about 100° F., preferably 120° . The softening agents of the invention typically have highest efficiency when the wax is melted, resulting in a liquid phase for the efficient transfer of hardness components of service water into the interior inner aqueous phase.

A room temperature solid wax can be used in conjunction with a second organic composition in different modes including: (1) with a wax that can melt at use temperature, (2) with an organic solid or semi-solid matrix, and (3) with two waxes, a first wax having a melting point below the temperature of use solution and a second wax having a melting point above the use solution.

In detersive systems having greater than 500 ppm or greater than 200 ppm aqueous cleaning surfactant or organic detergent the use of wax as the organic phase or as an organic phase encapsulate is preferred.

Inner Aqueous Phase

An inner aqueous phase is contained within the exterior organic phase of the softening agent. The inner aqueous phase can contain a strongly ionized salt. We believe that the excess concentration of the cation of the neutral salt in the inner aqueous phase versus the outer bulk aqueous phase provides the driving force for the softening effect. The cations formed by the ionization of the salt in the inner aqueous phase are transferred to the bulk aqueous phase by the complexing agent where they are exchanged for hardness cations. Depending on end use and hardness of service water the inner aqueous phase can comprise from about 10 to 99 wt-% water and from about 1 to 90 wt-% salt. Preferably the inner aqueous phase comprises from about 15 to 98 wt-% water and from about 2 to 85 wt-% salt for reasons of emulsion stability and softening agent capacity for hardness ions. Most preferably the inner aqueous phase comprises from about 15–90 wt-% water and from about 10–85 wt-% salt for reasons of emulsion stability and economy. The upper limit of the salt component is dependent in part upon the solubility of the particular salt utilized in water. Salts comprising organic and inorganic anions and cations can be utilized in the softening agent of this invention.

Useful salts in the present invention should have the following characteristics: They should be very soluble in water, not decompose in water or upon contact with the organic phase, be relatively inexpensive, be relatively non-toxic and not form any toxic salts or compounds in combination with the bulk water ions or organic phase components. Preferably the salt utilized comprises sodium chloride for reasons of cost.

To be useful the salt must be soluble in water at concentrations of at least about 0.1 moles/liter in order to provide a concentration gradient that will sufficiently drive the softening effect, preferably about 2 to 24 moles/liter for reasons of "softening agent hardness capacity". "Softening agent hardness capacity" refers to the total moles of hardness ions that a given weight of softening agent can extract from the water before becoming exhausted of neutral salt cations. Most preferably the salt is present at a concentration gradient of about 6 to 20 moles/liter for reasons of softening agent hardness capacity and emulsion stability. As previously indicated, the upper limit on the concentration for each salt is ultimately determined by its solubility in water.

It is possible that a salt may be utilized in the inner aqueous phase which would result in the inner aqueous phase having an acidic pH. The salt should be selected such that the pH of the inner aqueous phase is not less than about 4.0 in order to minimize possible corrosion problems.

It is preferable that the concentration of salt in the inner aqueous phase be high in order that the softening agent perform as efficiently as possible. The more efficient the softening agent, the less softening agent needs to be utilized in order to perform a softening function. However, if the concentration of the salt in the inner aqueous phase is too high, the softening agent will be less stable due to the higher difference in densities between the inner aqueous phase and the exterior organic phase. This lack of stability is due to the tendency of the greater density inner aqueous phase to settle out of or be driven out of the less dense exterior organic phase by centrifugal and inertial forces.

The bulk aqueous phase typically contains calcium bicarbonate and magnesium bicarbonate which is often present in hard water at neutral pH's. Thus, the salt cation utilized must not readily react with carbonate anions to form a precipitate in the bulk aqueous phase.

Examples of salts which can be used in the inner aqueous phase include but are not limited to salts of the following acids, hydrochloric, hydroiodic, hydrobromic, chromic, nitric, sulfuric, sulfamic, phosphoric, and carboxylic acids such as citric acid, acetic acid, trihaloacetic acid, acrylic acid, polyacrylic acid polymers or mixtures thereof. The above acids can be neutralized into the form of soluble salts by reaction with bases typically including sodium hydroxide, potassium hydroxide, lithium hydroxide, cesium hydroxide, rubidium hydroxide, sodium carbonate, potassium bicarbonate, ammonium hydroxide, sodium bicarbonate, potassium bicarbonate, monosodium phosphate, monopotassium phosphate disodium phosphate, dipotassium phosphate, and other alkaline salts.

Thus, examples of useful salts include but are not limited to salts of the alkali metals lithium, sodium, potassium, rubidium, and cesium with the cations consisting of ($Li^+$, $Na^+$, $K^+$, $Rb^+$, and $Cs^+$ respectively) and salts of ammonium $NH_4^+$ with anions consisting of chloride, bromide, iodide, nitrate, acetate, sulfate, citrate, acrylate, phosphate, carbonate, bicarbonate, hydrogen phosphate and dihydrogen phosphate.

Thus, useful salts that can be included in the inner non-acidic aqueous phase of the present invention include but are not limited to the following sodium acetate, sodium bromide, sodium chloride, sodium citrate, sodium nitrate, sodium sulfate, sodium phosphate, potassium acetate, potassium bromide, potassium citrate, potassium iodide, potassium nitrate, potassium sulfate, potassium phosphate, lithium bromide, lithium chloride, lithium citrate, lithium iodide, lithium nitrate, lithium sulfate, lithium phosphate, cesium bromide, cesium chloride, cesium iodide, cesium nitrate, cesium phosphate, rubidium chloride, rubidium iodide, rubidium nitrate, rubidium sulfate, ammonium phosphate, ammonium sulfate, ammonium acetate, ammonium bromide, ammonium chloride, ammonium citrate, ammonium iodide, sodium carbonate, sodium dihydrogen phosphate, disodium hydrogen phosphate, potassium bicarbonate, potassium dihydrogen phosphate, dipotassium hydrogen phosphate, lithium bicarbonate, lithium dihydrogen phosphate, dilithium hydrogen phosphate, sodium chromate, lithium chromate, potassium chromate, potassium dichromate and potassium hydrogen sulfate depending upon the intended use of the softening agent of the invention.

Each salt should be carefully evaluated for its solubility, toxicity, stability and cost in order to determine the suitability of a particular salt in the softening agent of the present invention. Stability of the softening agent emulsion must be maintained with no appreciable coalescence occurring. Furthermore, the salt itself must not decompose or react with other materials present in the detersive system. Since items cleaned by detersive systems often come in contact with humans, the oral and dermal toxicity of each salt must be very low in case any residual salt is left on the item.

Detersive Systems

The liquid softening agents of this invention can be included in or used in conjunction with a detersive system. Detersive systems are concentrates that comprise a combination of ingredients that can be used primarily in dilute form in aqueous media and can act to remove soil from a substrate. The detersive systems of this invention are typically in the form of a liquid, a particulate, or solid. Liquids include flowable compositions including solutions, both dilute and concentrated, suspensions, gels and slurries. Particulates include products made by particle mixing, agglomeration,dry blending and granulation. Solids include cast solids, extrudates, pellets, or compressed solids.

A detersive system typically contains a detergent which is a chemical compound that can weaken or break bonds between soil and a substrate. Organic and inorganic detergents include surfactants, solvents, alkalis, basic salts and other compounds. A detersive system is typically used in a liquid cleaning stream, spray, bath, etc. which produces an enhanced cleaning effect that is caused primarily by the presence in the bath of a special solute (the detergent) that acts by altering the interfacial effects at the various phase boundaries (i.e. between soil, substrate and both) within the system. The action of the bath typically involves more than simply soil dissolution. The cleaning or washing process in a typical detersive system usually consists of the following sequence of operations. The soiled substrate is immersed or otherwise introduced into or contacted by a large excess of a bath containing a detergent solute. The soil and the underlying object or substrate typically becomes thoroughly wetted by the bath. The system is subjected to mechanical agitation by rubbing, shaking, spraying, mixing, pumping or other action to provide a shearing action which aids in the separation of the soil from the substrate. The bath now containing the soil is typically removed from the object to be cleaned, the object is rinsed and often dried.

Detersive systems are often used in cleaning hard surfaces such as sinks, tiles, windows, and other glass, ceramic, plastic or other hard surface dishware, and laundry or other textiles. Soils removed from substrates by the detersive systems are extremely variable in composition. They may be liquid, solid or a mixture thereof. The soils typically consist of mixtures of proteinaceous, carbohydrate, and fatty materials typically in combination with inorganic components and some water.

Detersive baths typically contain a detergent which is often an organic surfactant detersive component, an inorganic detersive component, or combinations of organic and inorganic components, and can typically be used in combination with other organic and inorganic components that provide additional properties or enhance the basic detersive property of the detersive component. The compositions dissolved or suspended in water to provide detersive systems are formulated to suit the requirements of the soiled substrate to be cleaned and the expected range of washing conditions. Few cleaning systems have a single component. Formulated detersive systems consisting of several components often out-perform single component systems. Materials which can be used independently in detersive systems are as follows:

(a) surfactants including various synthetic surfactants and natural soaps;

(b) inorganic builders, diluents, or fillers including salts, acids and bases;

(c) organic builder additives which enhance detergency, foaming power, emulsifying power, soil suspension;

(d) special purpose additives such as bleaching agents, brightening agents, enzymes, bactericides, anticorrosion agents, emollients, dyes, fragrances, etc.; and (e) hydrotrope solubilizers used to insure a compatible uniform mixture of components including alcoholic cosolvents, low molecular weight anionic surfactants, emulsifying agents, etc. When blending the detersive components and the softening agent, enhanced compatibility and stability can be achieved if the specific gravity of the liquid detersive system matches the specific gravity of the softening agent.

Organic Surfactant

The detersive systems of this invention can include an organic surfactant in combination with or in conjunction with the aqueous/organic softening agent. These surfactants are water soluble, and are to be distinguished from the oil soluble surfactant used to stabilize the softening agent water-in-oil emulsion.

Preferred surfactants are the nonionic, anionic, and cationic surfactants. Cationic surfactants such as quaternary ammonium compounds are frequently used in detersive systems but are typically not cleansing ingredients and are used for purposes such as sanitizing or fabric softening. A surfactant should be selected which is compatible with the oil-in-water emulsion. Surfactants which are very good oil emulsifiers or solubilizers will tend to strip away the exterior organic phase of the softening agent, thus destroying the water-in-oil emulsion.

Surfactants useful with the softening agents of this invention in the detersive systems comprise soaps, i.e. (a) sodium or potassium salts of fatty acids, rosin acids, and tall oil; (b) alkylarene sulfonates such as propylene tetramerbenzene sulfonate; (c) alkyl sulfates or sulfonates including both branched and straight chain hydrophobes as well as primary and secondary sulfate groups; (d) sulfates and sulfonates containing an intermediate linkage between the hydrophobic and hydrophilic groups such as taurides and sulfonated fatty mono glycerides, long chain acid esters of polyethylene glycol, particularly a tall oil ester; (f) polyalkylene glycol ethers of alkyl phenols wherein the alkylene group is derived from ethylene or propylene oxide or mixtures thereof; (g) polyalkylene glycol ethers of long chain alcohols or mercaptans, fatty acyl diethanolamides; (h) block copolymers of ethylene oxide and propylene oxide; and others.

Anionic surfactants such as alkyl or aryl sulfonates and amphoteric surfactants such as amine oxides are preferred for reasons of emulsion stability. Since these surfactants are also typically medium to high foaming surfactants some type of antifoam or foam breaker must be used for non-foaming detersive systems.

Inorganic Compounds

Detersive systems can contain inorganic detergent compounds which are typically grouped into the following six categories: alkalis, phosphates, silicates, neutral soluble salts, acids, and insoluble inorganic builders.

Sources of alkalinity useful in combination with or in conjunction with the liquid softening agents of the invention include but are not limited to the following: alkali metal hydroxides, alkali metal carbonates, alkali metal bicarbonates, alkali metal sesquicarbonate, alkali metal borates, and alkali metal silicate. The carbonate and borate forms are typically used in place of alkali metal hydroxide when a lower pH is desired. Silicates ($Na_2O:SiO_2$ compounds) which are typically a reaction product between sodium hydroxide and silica, have a variety of $Na_2O$: $SiO_2$ reaction molar ratios. Silicates are primarily used as alkalis and as builders in both warewashing and laundry formulations. We have found that the addition of base can aid in dispersing the softening agent in detersive systems.

Builders

Threshold agents can be useful in conjunction with or in combination with the softening agents of the invention include organic and inorganic carboxylates, phosphates, phosphonates and mixtures thereof. Such agents include but are not limited to the following: organic acrylate polymers, phosphinic and phosphonic acids, inorganic phosphate compositions including monomeric phosphate compounds such as sodium orthophosphate and the higher condensed phosphates including tetraalkali metal pyrophosphates, sodium tripolyphosphate, glassy phosphates and others. Threshold agents are typically used at low concentration, about 0 to 50 ppm, in order to slow or delay the formation of deposits of hardness components through a much less than stoichiometric reaction between the threshold agent and the inorganic components of hardness in service water. Very low levels of threshold agents are useful to prevent initial hardness precipitation as the softening agent of the present invention transfers the hardness ions from the bulk water into the inner aqueous phase. Useful concentrations of a threshold agent in a detersive system containing the softening agent of the present invention can range from about 1 to 25 ppm. Phosphates are typically used as sequestering, suspending and cleaning agents. Sodium tripolyphosphate is the most widely used builder in heavy duty detergents. The usage of the softening agent of the present invention in detergent systems serves as an alternative to the usage of high levels of inorganic sequestrants.

Neutral soluble salts (which are typically the reaction product of a strong acid and a strong base including sodium sulfate, sodium chloride, and others) are often used in conjunction with or in combination with the detersive systems of the invention. Neutral soluble salts are typically used as builders or diluents in synthetic surfactant based detersive compositions.

Insoluble inorganic bulking agents are often used in liquid, gel and solid detersive systems. The insoluble inorganics including clays, both natural and synthetic, such as montmorilonite clay or bentonite clay, can have a detersive effect in certain systems. Further, they can be used as suspending agents to maintain or stabilize a liquid or gelled system.

Organic Builders and Additives

Further, the detersive systems can contain organic builders and other special purpose additives. This class of compound is typically organic molecules having little detersive nature but containing many other desirable properties including antiredeposition additives, sequestrants, antifoaming or foaming additives, whiteners and brighteners, additives or hydrotropes for maintaining the solubility of components, and additives for protecting both the substrate and the washing apparatus. The most common organic additives include organic sequestrants and organic antiredeposition agents. Organic sequestrants include compositions such as polyacrylic acid and methacrylic acid polymers, ethylene diamine tetraacetic acid, nitrilo- triacetic acid, etc. and others.

Sources of Active Chlorine

Sources of active chlorine useful in conjunction with or in combination with the liquid softening agent of the invention include but are not limited to the following: alkali metal and alkaline earth metal hypochlorite, chlorinated condensed phosphates, dichloroisocyanurate, chlorinated cyanurate, and mixtures thereof. Specific examples of active chlorine sources include the following: sodium hypochlorite, calcium hypochlorite, chlorinated sodium tripolyphosphate and mixtures thereof.

Active chlorine sources have higher stabilities in detersive systems containing the softening agent of the present invention as opposed to detersive systems which include high acid containing softening agents since chlorine sources are more stable in alkali systems. "High acid" containing softening agents are described in U.S. Pat. Application Ser. No. 07/001,397 and are defined as softening agents which contain acids which disassociate to such an extent that the pH of the internal aqueous phase is less than 4 with acid concentration of at least 0.1 molar.

Common detersive systems in use today are laundry systems, industrial, institutional and household dishwashing or warewashing compositions, clean-in-place and hard surface cleaning compositions. The softening agents of the invention can be used in all of these detersive systems.

In aqueous dishwashing, detersive solutions are prepared from typically liquid, particulate or solid detersive systems by the action of water within a warewashing machine. The softening agent of this invention can be used in detersive compositions prepared from solid, particulate or liquid warewashing cleaners.

Dishwashing detersive systems typically comprise a source of alkali in the form of an alkali metal hydroxide, alkali metal carbonate, or alkali metal silicate in combination with a hardness sequestering agent, optional surfactants, a source of active halogen, and other optional chemical substances. The softening agents of this invention can effectively be used in warewashing detersive systems.

An aqueous surfactant and the softening agent of this invention can be used in a clean-in-place-cleaning environment in which the chemical properties of the aqueous surfactant and liquid softening agent solution pumped into and through a site requiring cleaning are relied on to the exclusion of mechanical soil removing processes in order to clean pipelines, process equipment, storage tanks, and other enclosed easily soiled locations. Such applications require significant detergency and stability to chemical soils.

The softening agents of the present invention can be used in laundry detersive systems. Laundry detersive systems typically in the form of liquid, particulate or solid compositions can be used in both household and institutional laundry equipment to clean and destain typically soiled fabric articles. Cleaning of such articles is typically accomplished by removing soil that is physically associated with the fabric and by destaining or bleaching soils that cannot be removed by typical detersive systems. Laundry compositions typically comprise anionic or nonionic surfactants, water, softening or hardness sequestering agents, foam stabilizers, pH buffers, soil suspending agents, perfumes, brighteners, opacifiers, and colorants. If the laundry detersive system is in liquid form typically the components are dissolved or suspended in water, while if in a gelled form the water solution is typically combined with a gelling agent.

Further, the softening agents of this invention can be used in a variety of liquid detergent compositions that can be used in a variety of environments including hard surface cleaning, hand cleaning, general household cleaning, car washing, recreational equipment cleaning, etc. Such detersive systems are used in the form as shown below or in aqueous solution prepared from the compositions as shown below.

TABLE A

Liquid Hard Surface Cleaner
Surfactant - Softening Agent Composition

| Preferred Component | Useful Wt % | Preferred Wt % | Most Preferred Wt % |
|---|---|---|---|
| Surfactant | 0.1–95 | 0.5–20 | 0.5–10 |
| Softening agent | 0.1–40 | 1–30 | 10–30 |
| Water | Balance | Balance | Balance |
| Thickener | 0.5–50 | 0.5–20 | 0.5–10 |

TABLE B

Warewashing Cast (or C-I-P) Composition

| Preferred Component | Useful Wt % | Preferred Wt % | Most Preferred Wt % |
|---|---|---|---|
| Source of alkalinity | 5–70 | 10–60 | 20–50 |
| Chlorine source | 0.1–15 | 1–10 | 1–5 |
| Softening agent | 1–60 | 2–50 | 3–40 |
| Water | Balance | Balance | Balance |

TABLE C

Laundry Granular Composition

| Preferred Component | Useful Wt % | Preferred Wt % | Most Preferred Wt % |
|---|---|---|---|
| Surfactant | 0.1–50 | 1–40 | 1–25 |
| Source of alkalinity | 0.1–95 | 1–40 | 10–40 |
| Semi-solid wax based softening agent | 1–60 | 2–50 | 2–40 |

TABLE D

Detersive Composition

| Preferred Component | Useful Wt % | Preferred Wt % | Most Preferred Wt % |
|---|---|---|---|
| Source of alkalinity | 0.1–60 | 0.5–50 | 1–40 |
| Surfactant | 0.5–10 | 1–5 | 1–4 |
| Chlorine source | 0.5–10 | 1–5 | 1–4 |
| Softening agent | 1–60 | 2–50 | 3–40 |

TABLE E

Liquid Softening Agent

| Preferred Component | Useful Vol % | Preferred Vol % | Most Preferred Vol % |
|---|---|---|---|
| EXTERIOR ORGANIC PHASE | 25–95 | 25–80 | 30–80 |
| INNER AQUEOUS PHASE | 5–75 | 20–75 | 20–70 |
| EXTERIOR ORGANIC PHASE Components: | Wt % | Wt % | Wt % |
| Organic Solvent | 0.1–99.9 | 20–99 | 25–90 |
| Complexing agent | 0.1–99.9 | 1–50 | 1–40 |
| Surfactant | 0.1–50 | 1–30 | 1–20 |
| INNER AQUEOUS PHASE Components: | | | |
| Salt | 0.1–90* | 2–85* | 10–85* |
| Water | Balance | Balance | Balance |

*Wherein the upper limit of the neutral soluble salt component is dependent upon the solubility of the particular salt utilized.

One method to prepare a cast solid detergent is as follows: alkali metal salts, preferably in the form of sodium carbonate or sodium hydroxide beads or sodium silicates, are stirred into an aqueous sodium hydroxide solution. The composition is heated to a temperature of 200° F. until the composition becomes uniform. The mixture is then cooled to 145° F. Then, the softening agent is slowly added to the bottom of the mix tank. The mixture is stirred until uniform, maintaining the temperature of the mixture between 145°–160° F. The mixture is then cooled to 140°–142° F., and is poured into a mold where the mixture hardens to a cast solid detergent block. The softening agent is thus trapped in the solid caustic matrix as small, dispersed droplets.

The detergent block is dispensed into a washing machine by a water spray which erodes or dissolves the block. A conductivity probe monitors the concentration of the detergent in the wash solution.

To prepare a liquid detergent composition, a thickener is added to a liquid detergent base containing a source of alkalinity, usually sodium hydroxide, and a surfactant dissolved in the water. The softening agent is then added to the thickened liquid base with agitation to disperse the softening agent evenly in the slurry. The slurry would then be pumped or in some way metered out into the washing process.

The softening agents used in this invention are water-in-oil emulsions, and therefore, any liquid detergent employing them must be a water-in-oil-in-water emulsion. The main stabilizing agent used to make these double emulsions is a viscosity builder, or thickener, which prevents coalescence of the dispersed liquid emulsion droplets. Thickeners which can be utilized include such compounds as Laponite® RDS, which is a trademark of Laporte Industries Ltd., a clay; Natrosol®, which is a trademark of Hercules, Inc., a hydroxyethyl cellulose; and polyacrylates, preferably having molecular weights close to 4,000.

Small droplets of the softening agent should be utilized in the liquid detergent composition so that the softening agent will not be excessively sheared during the preparation of the detergent composition. If the softening agent is subjected to high shear during preparation, it will tend to break the emulsion and reduce its effectiveness.

To prepare particulate detergent compositions, the softening agent must be made in a solid form. The selection of an oil phase of the softening agent in the form of a wax with a melting point above room temperature is an acceptable choice. Other solid phases can be used if solid at room temperature and if melted at the washing process temperature (i.e. 120°-180° F.). The emulsion can be processed to form solid particles of the emulsion in which the acid aqueous phase is held within the solidified exterior phase. The particulates may be formed by spraying a stream of the molten material into a fluid such as air or water such that the fluid is significantly below the solidification temperature of the exterior phase. The particulates may be on the order of 25-1000 microns in diameter.

The following Examples further illustrate the invention and provide a best mode.

EXAMPLE I

A liquid softening agent was prepared having the following composition:

50 Vol-% Organic Solvent Phase (63 75 q.):

78.7 wt-%, 50.15 g., light mineral oil (Klearol® mineral oil, Witco Chemical Corporation)

9.5 wt-%, 6.06 g., di-2-ethyl-hexylphosphoric acid (DEHPA complexing agent) (0.25 M in oil phase)

2.0 wt-%, 1.27 g., polyethyleneimine derivative of polyalkenyl substituted succinimide (M.W. about 2000; Paranox 105, Exxon Corporation surfactant)

9.8 wt-%, 6.27 g., CYANEX® 272, American Cyanamid Company, bis (2,4,4-trimethylpentyl) phosphinic acid, a dialkyl phosphinic acid. (0.25 M in oil phase)

50 Vol-% Non-Acidic Inner Acueous Phase (77.2 g.):

75 ml. 1 M NaCl in deionized water

The liquid softening agent was prepared in a 250 ml beaker by dissolving the DEHPA complexing agent in the mineral oil and mixing in the polyimine surfactant and the CYANEX-272. The organic solvent phase was mixed in a Tekmar rotor/stator emulsifier at 70% power for 30 minutes, and the 1 M NaCl solution was slowly added until the components were fully dispersed. The emulsion was then blended for about 5 minutes to insure fine dispersion of the water droplets in the oil phase.

An aqueous phase consisting of 880 g. unbuffered tap water was used. The liquid softening agent (7.04 g.) was added to produce a concentration of 8000 ppm softening agent. The water temperature was 160° F. The softening agent was dispersed in the water by means of a flat blade turbine agitator operating at 600 rpm.

The total amount of calcium and magnesium ions removed from the aqueous or bulk solution by the softening agent was measured at various time intervals by taking 10 ml samples, filtering and titrating with EDTA. Table F (below) reveals that a significant removal of hardness (Ca++and Ma++) occurred in the 20 minute time period.

TABLE F

| Softening Performance | | | |
|---|---|---|---|
| Time (Minutes) | Volume (ml) | Total Grains Per Gallon (as $CaCO_3$) | Wt % of Original Hardness Extracted |
| 0 | 880 | 16.6 | 0.0 |
| 2 | 870 | 9.0 | 46.1 |
| 5 | 860 | 8.6 | 48.5 |
| 10 | 850 | 8.3 | 50.3 |
| 20 | 840 | 7.9 | 52.7 |

EXAMPLE II

Example I was repeated except that a 4 M NaCl solution was used as the non-acidic inner aqueous phase.

The hardness transfer experiment was run under the same conditions as in Example I. The results are shown below in Table G and in FIG. II.

TABLE G

| Softening Performance | | | |
|---|---|---|---|
| Time (Minutes) | Volume (ml) | Total Grains Per Gallon (as $CaCO_3$) | % of Original Hardness Extracted |
| 0 | 880 | 15.6 | 0.0 |
| 2 | 870 | 8.8 | 43.9 |
| 5 | 860 | 8.2 | 47.7 |
| 10 | 850 | 7.2 | 54.2 |
| 20 | 840 | 6.7 | 56.8 |

The results show a significant softening effect.

EXAMPLE III

Example II was repeated except the inner aqueous phase consisted of 0.8 M $Na_2SO_4$. The same Tekmar procedure and experimental conditions were used as in Example II. The results are shown in Table H and in FIG. III.

TABLE H

| Softening Performance | | | |
|---|---|---|---|
| Time (Minutes) | Volume (ml) | Total Grains Per Gallon (as $CaCO_3$) | % of Original Hardness Extracted |
| 0 | 880 | 16.9 | 0.0 |
| 2 | 870 | 8.9 | 47.6 |
| 5 | 860 | 7.2 | 57.5 |
| 10 | 850 | 7.7 | 54.7 |
| 20 | 840 | 6.6 | 60.7 |

EXAMPLE IV

Example IV illustrates that even with a slightly alkaline inner aqueous phase, the softening agent emulsion is stable and successfully transfers hardness ions with an ionized salt in the inner aqueous phase.

A liquid softening agent was prepared having the following composition:

50 vol-% organic solvent phase 78.7 wt-%, 13.37 g., light mineral oil (Klearol® Mineral Oil, Witco Chemical Corporation)

9.5 wt-%, 1.62 g., di-2-ethyl-hexylphosphoric acid (DEHPA complexing agent 0.25 M in oil)

2.0 wt-%, 0.34 g., polyethyleneimine derivative of polyalkenyl substituted succinimide (MW about 2000; Paranox 105, Exxon surfactant) and 9.8 wt-%, 1.67 g., CYANEX-272 complexing agent (0.25 M in oil)

50 vol-% inner aqueous phase:

2 M NaCl, 50 ppm NaOH (0.005%)

The organic solvent phase components were blended together. Next, the inner aqueous phase was added and dispersed in the organic solvent phase for 4 minutes using an ultrasonic emulsifier. The emulsion appeared smooth and stable.

A bulk aqueous phase consisting of 880 g. tap water with 50 ppm NaOH was used. The liquid softening agent (7.04 g.) was added with 600 rpm agitation to produce a concentration of 8000 ppm softening agent. The water temperature was 160° F.

The total amount of calcium and magnesium ions removed from the bulk aqueous solution by the softening agent was measured at various time intervals by taking 10 milliliter samples and filtering out the softening agent. The results, presented in Table I, show significant hardness removal.

TABLE I

| Softening Performance | | | | |
|---|---|---|---|---|
| Time (Minutes) | Volume (ml) | Total Grains Per Gallon (as $CaCO_3$) | % of Original Hardness Extracted | pH |
| 0 | 880 | 15.5 | 0.0 | 7.40 |
| 2 | 870 | 9.5 | 38.6 | 7.60 |
| 5 | 860 | 9.2 | 40.5 | 7.60 |
| 10 | 850 | 8.4 | 45.8 | 7.70 |
| 20 | 840 | 9.2 | 40.5 | 7.80 |

EXAMPLE V

A liquid softening agent was prepared having the following composition according to the method of Example IV.

50 Vol-% Organic Solvent Phase 81.37 wt-%, 4.15 g., light mineral oil (Klearol® mineral oil, Witco Chemical Corporation)

14.71 wt-%, 0.75 g., bis(hexacosyl) phosphate (complexing agent) (0.1 M in oil phase)

3.92 wt-%, 0.20 g., polyethyleneimine derivative of polyalkenyl substituted succinimide (M.W. about 2000; Paranox 105, Exxon Corporation surfactant)

50 Vol-% Non-Acidic Inner Acueous Phase 1.0 M NaCl in deionized water

The total amount of hardness ions removed from the bulk aqueous solution by the softening agent was measured at various time intervals by taking 10 milliliter samples and filtering out the softening agent. The results, presented in Table J which contain the average of two identically performed experiments, shows significant hardness removal.

TABLE J

| Softening Performance | | | |
|---|---|---|---|
| Time (Minutes) | Volume (ml) | Total Grains Per Gallon (as $CaCO_3$) | % of Original Hardness Extracted |
| 0 | 880 | 13.5 | 0.0 |
| 2 | 870 | 11.3 | 16.9 |
| 5 | 860 | 10.7 | 20.9 |
| 10 | 850 | 10.8 | 20.3 |
| 20 | 840 | 10.5 | 22.7 |

EXAMPLE VI

A liquid softening agent was prepared having the following composition according to the method of Example IV.

50 Vol-% Organic Solvent Phase 0 59.41 wt-%, 3.03 g., light mineral oil (Klearol ®0mineral oil, Witco Chemical Corporation)

36.67 wt-%, 1.87 g., bis(hexacosyl) phosphate (complexing agent) (0.25 M in oil phase)

3.92 wt-%, 0.20 g., polyethyleneimine derivative of polyalkenyl substituted succinimide (M.W. about 2000; Paranox 105, Exxon Corporation surfactant)

50 Vol-% Non-Acidic Inner Aqueous Phase 1.0 M NaCl in deionized water

The total amount of calcium and magnesium ions removed from the bulk aqueous solution by the softening agent was measured at various time intervals by taking 10 milliliter samples and filtering out the softening agent. The results, presented in Table K, which contain the average of two identically performed experiments, shows significant hardness

TABLE K

| Softening Performance | | | |
|---|---|---|---|
| Time (Minutes) | Volume (ml) | Total Grains Per Gallon (as $CaCO_3$) | % of Original Ca++ Extracted |
| 0 | 880 | 13.4 | 0.0 |
| 2 | 870 | 10.8 | 20.0 |
| 5 | 860 | 9.9 | 26.6 |
| 10 | 850 | 8.8 | 34.6 |
| 20 | 840 | 9.1 | 40.1 |

EXAMPLE VII

A liquid softening agent was prepared having the following composition according to the method of Example IV.

50 Vol-% Organic Solvent Phase 26.49 wt-%, 1.43 g., light mineral oil (Klearol mineral oil, Witco Chemical Corporation)

69.44 wt-%, 3.75 g., bis(hexacosyl) phosphate (complexing agent) (0.50 M in oil phase)

4.07 wt-%, 0.22 g., polyethyleneimine derivative of polyalkenyl substituted succinimide (M.W. about 2000; Paranox 105, Exxon Corporation surfactant)

50 Vol-% Non-Acidic Inner Aqueous Phase )

1.0 M NaCl in deionized water

The total amount of calcium and magnesium ions removed from the bulk aqueous solution by the softening agent was measured at various time intervals by taking 10 milliliter samples and filtering out the softening agent. The results, presented in Table L, show significant hardness removal.

TABLE L

| Softening Performance | | | |
|---|---|---|---|
| Time (Minutes) | Volume (ml) | Total Grains Per Gallon (as $CaCO_3$) | % of Original Ca++ Extracted |
| 0 | 880 | 13.3 | 0.0 |
| 2 | 870 | 9.6 | 27.5 |
| 5 | 860 | 9.2 | 30.6 |
| 10 | 850 | 8.1 | 38.8 |
| 20 | 840 | 7.3 | 45.0 |

While the invention has been explained fully in the detailed discussion found above of the specific embodiments of the invention, many embodiments of the invention can be made without departing from the spirit and scope of the invention. The invention resides in the claims hereinafter appended.

We claim:

1. A detersive system, that can remove divalent or trivalent ions from service water and can clean soiled surfaces or articles, comprising:

(a) an effective detersive amount of a soil removing detergent;

(b) an effective amount of a hardness sequestering agent, dispersed in the detergent, which hardness sequestering agent comprises:

(1) about 25 to 95 vol.-% of an exterior organic phase having:

(i) an organic medium; and (ii) about 0.1 to 99.9 wt-% based on the organic phase of an organic soluble hardness ion complexing agent; and (2) about 5 to 75 vol.-% of an inner aqueous phase dispersed within the exterior organic medium which comprises:

(i) water; and (ii) about 1 to 90 wt-% based on the aqueous phase of an aqueous soluble salt; and (3) about 0.1 to 50 wt-% based on the organic phase of a surfactant that can stabilize the dispersed inner aqueous phase within the exterior organic phase.

2. The detersive system of claim 1 wherein the complexing agent is selected from the group consisting of an alkyl substituted phosphorous acid compound, an alkyl substituted sulfonic acid compound, a carboxylic acid compound, or salts thereof and mixtures thereof.

3. The detersive system of claim 1 wherein the complexing agent comprises the alkyl substituted phosphorous acid is an alkyl substituted phosphoric acid, alkyl substituted phosphonic acid, alkyl substituted phosphinic acid, salts thereof or mixtures thereof.

4. The complexing agent of claim 1 where in the complexing agent is a bisalkyl phosphoric acid or a salt thereof, wherein each alkyl group contains between 8 and 36 carbon atoms.

5. The detersive system of claim 1 wherein the softening agent comprises droplets having a droplet size of about 0.05 to 2,000 microns.

6. The detersive system of claim 1 wherein the softening agent comprises droplets having a droplet size of about 1 to 1,000 microns.

7. The detersive system of claim 1 wherein the detersive system is a solid.

8. The detersive system of claim 7 wherein the solid is a cast solid.

9. The detersive system of claim 1 wherein the detersive system is a liquid.

10. The detersive system of claim 1 wherein the soil removing detergent comprises a surfactant selected from the group consisting of nonionic surfactant, cationic surfactant, and anionic surfactant and mixtures thereof.

11. The detersive system of claim 1 wherein the soil removing detergent comprises an inorganic detergent selected from the group consisting of an alkaline metal silicate, an alkaline metal hydroxide, an alkaline metal carbonate, an alkaline metal bicarbonate, and mixtures thereof.

12. The detersive system of claim 1 wherein the organic medium is selected from the group consisting of an aromatic hydrocarbon, a naphthenic hydrocarbon, a paraffinic hydrocarbon, a petroleum white oil, a wax, a silicone oil, a halogenated hydrocarbon, a fatty acid, and mixtures thereof.

13. The detersive system of claim 1 wherein the soluble salt is a neutralization reaction product of a base and an acid.

14. The detersive system of claim 9 wherein the surfactant that can stabilize the dispersed inner aqueous phase comprises an alkyl substituted polyethyleneimine or alkyl substituted amine.

15. A warewashing detersive system, capable of removing soil from flatware, dishware or other hard surfaces and capable of removing divalent or trivalent ions from service water, comprising:

(a) about 0.1 to 95 wt-% of a source of an inorganic alkaline detergent;

(b) about 2 to 60 wt-% of a hardness sequestering agent dispersed in the detersive system, which hardness sequestering agent comprises:

(1) about 25 to 95 vol.-% of an exterior organic phase comprising a an organic medium and about 0.1 to 99.9 wt-% of an organic soluble hardness ion complexing agent; and (2) about 5 to 75 vol.-% of an inner aqueous phase dispersed within the exterior organic medium which comprises water and about 1 to 90 wt-% of an aqueous soluble salt; and (3) about 0.1 to 50 wt-%, based on the organic phase, of a surfactant to stabilize the dispersed inner aqueous phase within the exterior organic phase; and (c) about 0.1 to 25 wt-% of a source of active halogen.

16. The detersive system of claim 15 wherein the alkaline detergent comprises an alkali metal carbonate, an alkali metal bicarbonate, an alkali metal silicate, an alkali metal hydroxide, or mixtures thereof.

17. The detersive system of claim 15 wherein the source of active halogen comprises an alkali metal hypohalide, an alkali metal dihaloisocyanurate, a halogenated alkali metal tripolyphosphate or mixtures thereof.

18. The detersive system of claim 15 wherein the dispersed softening agent comprises droplets having a droplet size of about 0.05 to 2,000 microns.

19. The detersive system of claim 15 wherein the dispersed liquid softening agent comprises droplets having a droplet size of about 1 to 1,000 microns.

20. The detersive system of claim 15 wherein the detersive system is a particulate solid or a cast solid.

21. The detersive system of claim 15 wherein the detersive system is a liquid.

22. The detersive system of claim 15 wherein the organic medium is selected from the group consisting of an aromatic hydrocarbon, a naphthenic hydrocarbon, a paraffinic hydrocarbon, a petroleum white oil, a wax, a silicone oil, a halogenated hydrocarbon, a fatty acid and mixtures thereof.

23. The detersive system of claim 15 wherein the aqueous soluble salt is a salt neutralization reaction product of a base and an acid.

24. An agent for removing hardness from an aqueous phase comprising: about 25 to 95 vol.-% of an exterior organic phase having an organic medium; and about 0.1 to 99.9 wt-% based on the organic phase of an organic soluble hardness ion complexing agent; and about 5 to 75 vol.-% of an inner aqueous phase dispersed within the exterior organic phase which comprises water; and about 1 to 90 wt-% based on the inner aqueous phase of an aqueous soluble salt; and about 0.1 to 50 wt-% based on the organic phase of a surfactant that can stabilize the dispersed inner aqueous phase within the exterior organic phase.

25. The agent of claim 24 wherein the organic medium is a liquid at room temperature.

26. The agent of claim 24 wherein the organic medium is a solid at room temperature.

27. The agent of claim 24 wherein the aqueous soluble salt comprises the neutralization reaction product of an acid and a base.

28. The softening agent of claim 24 wherein the organic medium is selected from the group consisting of an aromatic hydrocarbon, a naphthenic hydrocarbon, a paraffinic hydrocarbon, petroleum white oil, a wax, a silicone oil, a halogenated hydrocarbon, a fatty acid, and mixtures thereof.

29. The softening agent of claim 24 wherein the complexing agent comprises an alkyl substituted phosphorous acid compound, an alkyl substituted sulfonic acid compound, a carboxylic acid compound, or salts thereof and mixtures thereof.

30. The softening agent of claim 24 wherein the complexing agent comprises the alkyl substituted phosphorous acid is an alkyl substituted phosphoric acid, alkyl substituted phosphonic acid, alkyl substituted phosphinic acid, salts thereof or mixtures thereof.

31. The softening agent of claim 24 wherein the complexing agent is a bisalkyl phosphoric acid or a salt thereof, where each alkyl group contains between 8 and 36 carbon atoms.

32. A method of preparing a softening agent which comprises: combining an exterior organic phase and an interior aqueous phase, wherein the exterior organic phase is present at a concentration of about 25 to 95 vol-% and comprises a proportion of an organic medium and about 0.1 to 99.9 wt-% based on the organic phase of an organic soluble hardness ion complexing agent; wherein the inner aqueous phase comprises 5 to 75 vol-% of the softening agent and comprises a proportion of water and about 1–90 wt-% based on the organic phase of an aqueous soluble salt and about 0.1 to 50 wt-% based on the organic phase of a surfactant that can stabilize the dispersed aqueous phase within the exterior organic phase.

33. The method of claim 32 wherein the complexing agent is selected from the group consisting of an alkyl substituted phosphorous acid compound, an alkyl substituted sulfonic acid compound, a carboxylic acid compound, or salts and mixtures thereof.

34. The method of claim 32 wherein the complexing agent comprises the alkyl substituted phosphorous acid is an alkyl substituted phosphoric acid, alkyl substituted phosphonic acid, alkyl substituted phosphinic acid, salts., thereof or mixtures thereof.

35. The method of claim 32 where in the complexing agent is a bisalkyl phosphoric acid or a salt thereof, wherein each alkyl group contains between 8 and 36 carbon atoms.

36. A method of preparing a detersive system that can remove divalent or trivalent ions from service water and can clean soiled surfaces or articles comprising: (a) dispersing in a soil removing detergent an effective amount of a softening agent product made by combining an exterior organic phase and a inner aqueous phase wherein the exterior organic phase is present at a concentration of about 25 to 95 vol-% and comprises a proportion of an organic medium and about 0.5 to 99 wt-% based on the organic phase of an organic soluble hardness ion complexing agent; wherein the inner aqueous phase comprises 5 to 75 vol-% of the softening agent and comprises a proportion of water and about 1 to 90 wt-% based on the organic phase and about 0.1 to 50 wt-% based on the organic phase of a surfactant that can stabilize the dispersed aqueous phase within the exterior organic phase.

37. A method of cleaning soiled articles or surfaces which comprises dispersing the detersive system of claim 1 in an aqueous medium to form a use composition and contacting the use composition with the soiled article or surface.

38. A method of cleaning soiled articles or surfaces which comprises dispersing the detersive system of claim 15 in an aqueous medium to form a use composition and contacting the use composition with the soiled article or surface.

39. A detersive laundry system, that can remove soil from fabric and remove divalent ions or trivalent ions from service water, comprising:

(a) about 0.1 to 50 wt-% of a soil removing detergent;
(b) about 0.1 to 95 wt-% of a source of alkalinity; and
(c) about 2 to 60 wt-% of a softening agent dispersed within the detersive system comprising:
  (1) about 25 to 95 vol.-% of an exterior organic phase which comprises a major proportion of an organic medium, and about 0.1 to 99.9 wt-% of an organic soluble hardness ion complexing agent;
  (2) about 5 to 75 vol.-% of an inner aqueous phase dispersed within the exterior organic solvent phase which comprises water, and about 1 to 90 wt-% of an aqueous soluble salt; and
  (3) about 0.1 to 50 wt-%, based on the organic phase, of a surfactant to stabilize the dispersed inner aqueous phase within the exterior phase.

40. The detersive system of claim 39 wherein the softening agent comprises droplets having a droplet size of about 0.05 to 2,000 microns.

41. The detersive system of claim 39 wherein the softening agent comprises droplets having a droplet size of about 1 to 1,000 microns.

42. The detersive system of claim 39 wherein the detersive system is a solid.

43. The detersive system of claim 39 wherein the solid is a cast solid.

44. The detersive system of claim 39 wherein the detersive system is a liquid.

45. The detersive system of claim 39 wherein the soil removing detergent comprises a surfactant selected from the group consisting of nonionic surfactant, cationic surfactant, and anionic surfactant and mixtures thereof.

46. The detersive system of claim 39 wherein the soil removing detergent comprises an inorganic detergent selected from the group consisting of an alkaline metal silicate, an alkaline metal hydroxide, an alkaline metal carbonate, an alkaline metal bicarbonate, and mixtures thereof.

47. The detersive system of claim 39 wherein the organic medium is selected rom the group consisting of an aromatic hydrocarbon, a naphthenic hydrocarbon, a paraffinic hydrocarbon, a petroleum white oil, a wax, a silicone oil, a halogenated hydrocarbon, a fatty acid, and mixtures thereof.

48. The detersive system of claim 39 wherein the soluble salt is a neutralization reaction product of a base and an acid.

49. The detersive system of claim 39 wherein the surfactant that can stabilize the dispersed inner aqueous phase comprises an alkyl substituted polyethyleneimine or alkyl substituted amine.

50. The detersive system of claim 39 wherein the complexing agent is selected from the group consisting of an alkyl substituted phosphorous acid compound, an alkyl substituted sulfonic acid compound, a carboxylic acid compound, or salts thereof and mixtures thereof.

51. The detersive system of claim 39 wherein the complexing agent comprises the alkyl substituted phosphorous acid is an alkyl substituted phosphoric acid, alkyl substituted phosphonic acid, alkyl substituted phosphinic acid, salts thereof or mixtures thereof.

52. The complexing agent of claim 39 where in the complexing agent is a bisalkyl phosphoric acid or a salt thereof, wherein each alkyl group contains between 8 and 36 carbon atoms.

* * * * *

UNITED STATES PATENT AND TRADEMARK OFFICE

CERTIFICATE OF CORRECTION

PATENT NO. : 4,911,856

DATED : March 27, 1990

INVENTOR(S) : KEITH D. LOKKESMOE et al.

It is certified that error appears in the above-identified patent and that said Letters Patent is hereby corrected as shown below:

Column 5, line 31, for "811" read --8-11--.
Column 15, line 40, for "(63 75 q.)" read --(63.75 g.)--.
Column 18, line 7, for "059.41 wt-%" read --59.41 wt-%--.
Column 18, line 22, for "hardness" read --hardness removal.--.

Signed and Sealed this

Thirteenth Day of August, 1991

*Attest:*

HARRY F. MANBECK, JR.

*Attesting Officer*

*Commissioner of Patents and Trademarks*